United States Patent [19]

Ruetenik

[11] 4,233,938

[45] Nov. 18, 1980

[54] FOLDING WING ASSEMBLY

[76] Inventor: Roger R. Ruetenik, West Lake Rd., Vermillion, Ohio 44089

[21] Appl. No.: 954,288

[22] Filed: Oct. 24, 1978

[51] Int. Cl.[3] ..... A63K 3/02; A01K 29/00

[52] U.S. Cl. ..... 119/15.5 A

[58] Field of Search ..... 119/15.5 R, 15.5 A; 49/34, 115; 160/193, 213; 272/5

[56] References Cited

U.S. PATENT DOCUMENTS

| | | | |
|---|---|---|---|
| 1,770,450 | 7/1930 | Bahr | 119/15.5 A |
| 2,461,780 | 2/1949 | Smith et al. | 119/15.5 A |
| 2,497,370 | 2/1950 | Phillips | 119/15.5 A |
| 2,633,825 | 4/1953 | Smith et al. | 119/15.5 A |
| 4,068,770 | 1/1978 | Boehringer | 160/213 X |

*Primary Examiner*—Robert Peshock
*Assistant Examiner*—Robert P. Swiatek
*Attorney, Agent, or Firm*—Squire, Sanders & Dempsey

[57] ABSTRACT

A folding wing assembly, particularly suitable for use as a race horse starting gate, is comprised of a mount rotatably supporting a plurality of wing-forming members joined at rotatable junctures in pivotal serial relationship whereby the members may be collapsed in accordion-like fashion.

15 Claims, 10 Drawing Figures

FOLDING WING ASSEMBLY

The present invention relates, generally, to foldable wing assemblies wherein a plurality of individual wing members are joined in pivotal serial relationship such that the deployed wing may be folded or collapsed in an accordion-like manner. More specifically, the present invention relates to a foldable wing assembly of the character aforesaid particularly suited for use as a race horse starting gate.

Various types of race horse starting gates are known in the prior art. Conventionally, starting gates utilized for harness race horses are secured to an automobile at or near the rear end. A pair of planar gate structures are generally utilized, each pivotally disposed in such a fashion that the gate members lie along the side of the automobile in a traveling configuration and are adapted for rotation to a position substantially perpendicular to the automobile body in a deployed configuration during the start of the race. Electrical, hydraulic or mechanical mechanisms are provided to move the gates between the two configurations.

For use in the starting of harness race horses, the gate members are deployed and the horses may be aligned at fixed positions behind the gate. The automobile moves along the track with the horses following the gate and, at the precise point on the track where the race is to begin, the automobile then rapidly accelerates to advance well ahead of the horses. Exemplary of the race horse starting devices of this variety are those disclosed in U.S. Pat. Nos. 2,510,828, 2,660,980, and 2,800,877.

Certain disadvantages inhere in this design. For example, should an outstretched gate strike the fence surrounding the track, a serious accident could result. It is difficult for the starter to clearly view the horses and drivers behind the gate. The gate members, when in the traveling position, extend well forward of the door of the automobile thus making access thereto quite cumbersome. Also, the automobile must be modified to accommodate the gate structure thus rendering it unsuitable for any other use.

Certain advantages over the aforementioned designs are provided by that disclosed in U.S. Pat. No. 2,497,370. This starting gate is comprised of a pair of foldable members secured to the rear end of an automobile. The starter faces the rear of the automobile and has control over the foldable gate members as well as acceleration of the vehicle. A driver is provided for steering purposes.

Each of the foldable gates in this design consists of a pair of gate members moveable about an intermediate rotatable joint. As the interior gate is moved from its traveling position adjacent the automobile, a complex pulley and cooperating wire structure causes movement of the outer gate member such that the two align in a deployed configuration roughly perpendicular to the automobile body. Some flexibility is provided in this manner; however, the complexity of the deployment mechanism is a substantial disadvantage. Also, while providing a rearwardly facing seat and control for the starter is advantageous, optimum vision of the horses and drivers by the starter is not achieved due to the obstruction provided by the gate itself. The need to extensively modify the automobile remains as a drawback.

In light of the disadvantage of the prior art noted above, it is a principal object of the present invention to provide a foldable wing assembly having a simple, yet highly efficient, design for accordion-like movement of a number of wing-forming members.

It is also a primary object of the present invention to provide an improved wing assembly particularly suitable for use as a race horse starting gate.

Yet another object of the present invention is to provide a race horse starting gate having a pair of collapsable wing assemblies which can be secured to a motor vehicle without extensive modification thereof.

Still another object of the present invention is to provide a race horse starting gate having a pair of foldable wing assemblies secured to the rear of a motor vehicle wherein control of both deployment of the assemblies and acceleration of the motor vehicle is achieved by a rearwardly facing starter elevated substantially above the wing-forming members of the gate.

It has now been determined, in accordance with the present invention that the foregoing and other objects may be realized by providing a folding wing assembly comprised of a mount rotatably supporting a plurality of wing-forming members which include at least one interior wing-forming member and a terminal wing-forming member, a rotatable juncture at the proximal end of each wing-forming member joining the same in pivotal serial relationship, primary fixed pivot members disposed at each of the junctures for each of the interior wing-forming members, secondary pivot members journalled at the distal end of each of the interior wing-forming members, coupling members joined successive wing-forming members to provide fixed rotational communication across the respective rotatable juncture, and linkage members providing operative engagement between adjacent primary and secondary pivot members. For use as a race horse starting gate, a pair of folding wing assemblies are secured to a motor vehicle, preferably a pick-up truck, wherein a starter is positioned substantially above the level of the wing assemblies such that the starter may clearly view the horses and drivers aligned behind the starting gate. Also, preferably, the rearwardly facing starter controls both the deployment of the wing assemblies from a collapsed configuration, wherein the wing-forming members lie substantially parallel to the body of the truck without obstructing access thereto, to a deployed configuration, wherein the wing-forming members extend generally perpendicular to the body of the truck. The starter is also provided with acceleration control of the vehicle.

Yet other objects and advantages of the present invention will become apparent to the skilled artisan upon examination of the detailed description of preferred embodiments, taken in conjunction with the figures of drawing; wherein.

The present invention relates, generally, to foldable wing assemblies comprised of a plurality of wing-forming members arranged in pivotal serial relationship whereby the assembly is collapsable in an accordion-like fashion. Along these lines, because the wing assembly of the present invention is particularly well suited for use as a race horse starting gate, the following description will be given in terms of such a preferred embodiment. However, the skilled artisan will appreciate that scope of the wing assembly described herein is much broader and, hence, such a description of a preferred embodiment is given as illustrative only.

Figure 1:
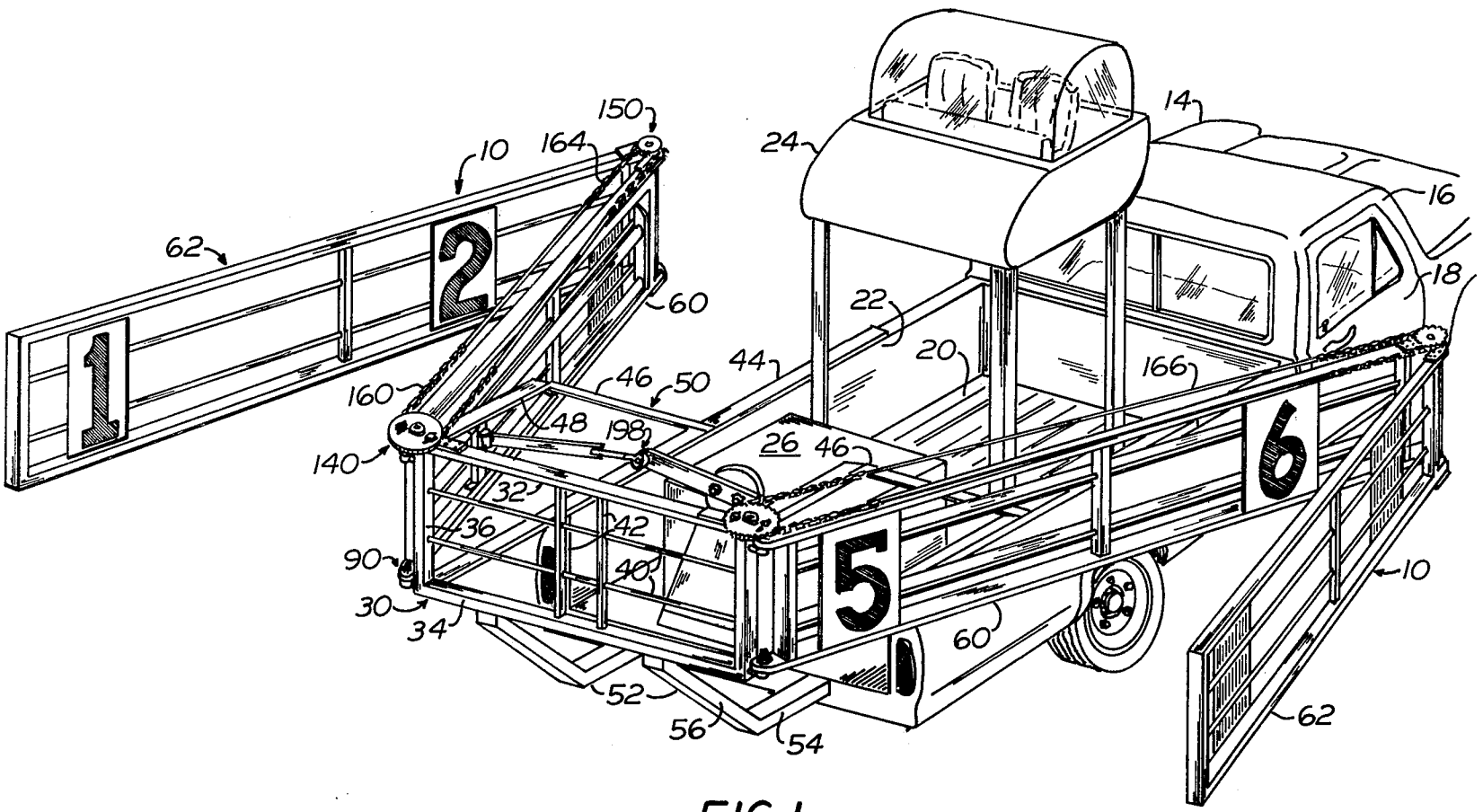
FIG. 1 is an isometric view of a truck provided with a pair of foldable wing assemblies in accordance with the present invention.

With reference to the figures of drawing, in all of which like parts are identified with like reference characters, FIG. 1 shows a pair of assemblies 10 secured to the rear of pick-up truck 14 to provide a race horse starting gate. The truck 14 includes a cab area 16 for housing a driver, access to the cab being made by way of doors 18. Behind the cab 16 is a bed 20 having upstanding sidewalls 22. Disposed within the bed 20 is an elevated starter's stand 24, to be described more fully below, and a housing 26 which covers the driving mechanism employed for moving the wing assemblies 10.

The wing assemblies 10 are supported by a frame 30 which is securely affixed to the rear of the truck bed 20. In the embodiment shown, the frame 30 is a planar array having upper and lower horizontal members 32 and 34, respectively, joined at their ends by vertical members 36 and 38 into a substantially rectangular configuration. Intermediate horizontal members 40 and vertical members 42 are provided to stiffen the frame structure.

The frame 30 is fastened to the truck 14 by a pair of longitudinal support rails 44 secured along their lengths to the top of side walls 22, and preferably welded to the frame 30 at the lower corners where the horizontal frame member 34 meets the two vertical members 36 and 38. A pair of upper anchoring members 46, each comprised of a horizontal leg 48 and an angled leg 50 are, preferably, welded between the support rails 44 and the upper corners of the support frame 30 where the horizontal member 32 meets the vertical members 36 and 38. A pair of lower anchoring members 52, similarly comprised of a substantially horizontal leg 54 and an angled leg 56, secure the lower portion of the frame 30 to the bed 20 of truck 14. As best viewed in FIG. 3, the support frame 30 thus projects somewhat beyond the end of the bed area 20.

Figure 2:
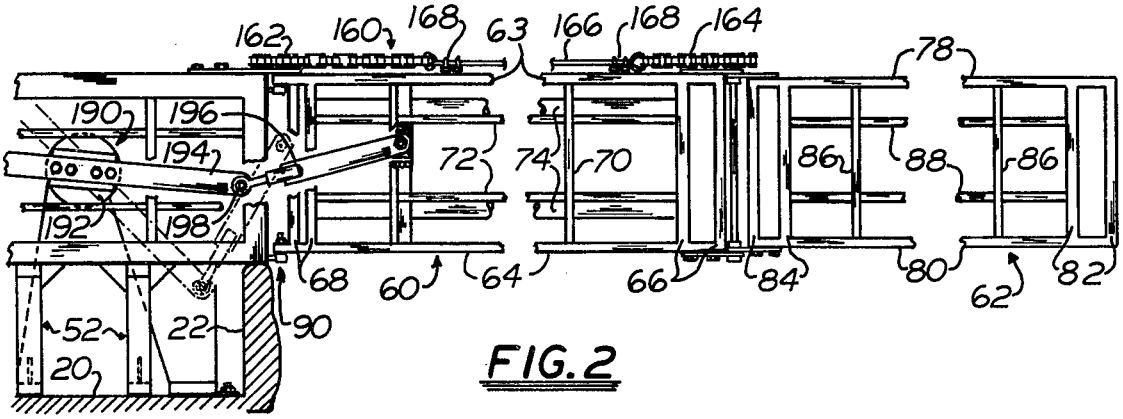
FIG. 2 is a fragmentary, rear elevational view of one of the assemblies of FIG. 1.
Figure 3:
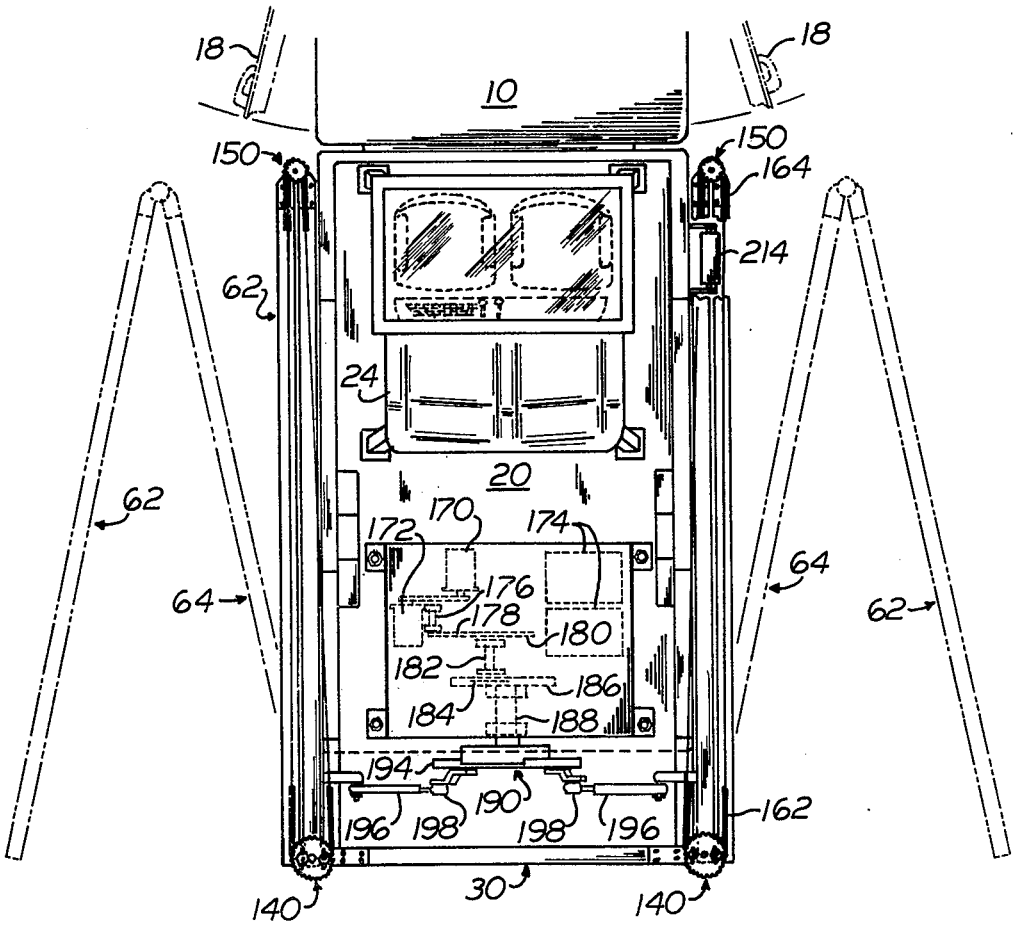
FIG. 3 is a top plan view of the starting gate shown in FIG. 1, with the assemblies partially deployed as shown in phantom lines.

Each wing assembly 10 is comprised of a plurality of wing-forming members, two such members 60 and 62 being shown in the embodiment of FIGS. 1–3. Accordingly, the member 60 will be referred to, alternately, as an interior wing-forming member whereas the member 62 will be referred to, alternately, as a terminal wing-forming member.

The wing-forming members 60 and 62, as viewed in FIG. 2, are in the form of a planar array of, preferably, tubular elements arranged in a substantially rectilinear fashion. The tubular elements may be of circular, square or rectangular cross sections, the tubular shape being preferred in order to minimize weight without substantially reducing strength and rigidity; an important consideration due to the cantilevered nature of the wing assembly 10, when in the deployed configuration (particularly when the assembly is utilized as a race horse starting gate because of the substantial forces exerted on the assemblies during movement of the vehicle 14). Depending upon the given application for the assemblies 10, the foregoing construction may be altered without departing from the spirit of the invention.

Figure 8:
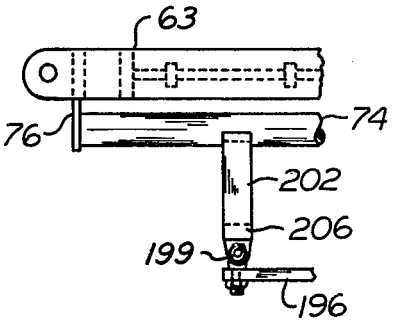
FIG. 8 is fragmentary, top plan view of the proximal end of the first wing-forming member.

The wing-forming member 60 is comprised of upper and lower horizontal members 63 and 64, respectively, joined at the distal ends by tubular members 66 and at the proximal ends by tubular members 68. A plurality of intermediate vertical members 70 and intermediate horizontal members 72 are provided to further strengthen and rigidify the wing-forming member 60. Because the interior wing-forming member 60 bears the weight of all successive wing-forming members, a pair of additional tubular members 74 are provided thereon to resist torsional movement of the assembly when in the deployed configuration. As best viewed in FIG. 8, these tubular members 74 are joined to the main rectangular frame structure of wing-forming member 60 by means of plate 76.

As shown in FIG. 2, the terminal wing-forming member 62 is similarly of rectangular configuration, comprised of upper and lower tubular members 78 and 80 joined at the distal ends by a pair of tubular members 82 and at the proximal ends by a pair of tubular members 84. A pair of intermediate vertical stiffening members 86 and horizontal stiffening members 88 are provided as in the case of the interior wing-forming member 60. Since the wing-forming member 82 is a terminal wing-forming member, it is beneficial to maintain its weight as low as possible to minimize the force exerted on the interior components of the assembly 10.

Figure 4:
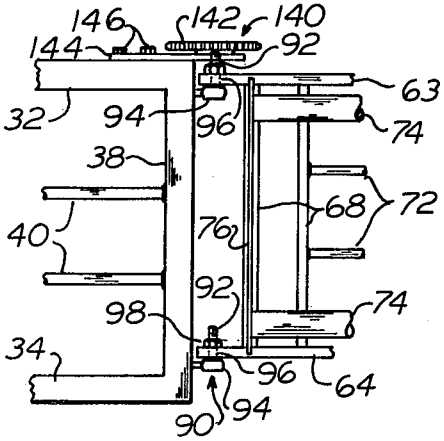
FIG. 4 is a fragmentary, rear elevational view of the mount for supporting the wing assemblies of the present inventions.

Each of the wing-forming assemblies 20 is pivotally supported about a rotatable juncture, designated generally as 90 and best viewed in FIG. 4. The rotatable juncture 90 is comprised of a pair of upright pin members 92 joined to the vertical frame members of the support 30 by offset members 94. Each of the upper and lower members 63 and 64 of the interior wing-forming members 60 is provided with a bore 96 for receiving the upright pins 92, the centerline along the bores and inserted pins defining an axis of rotation for the assembly 10. Preferably, each of the pin members 92 is threaded in order to accommodate a restraining nut 98 to securely affix the assemblies at rotatable juncture 90.

Figure 6:
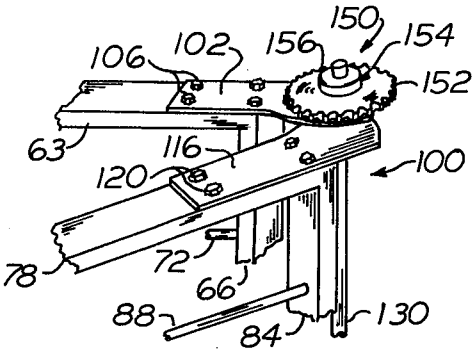
FIG. 6 is a fragmentary isometric view of a coupled rotatable juncture between successive wing-forming members.
Figure 10:
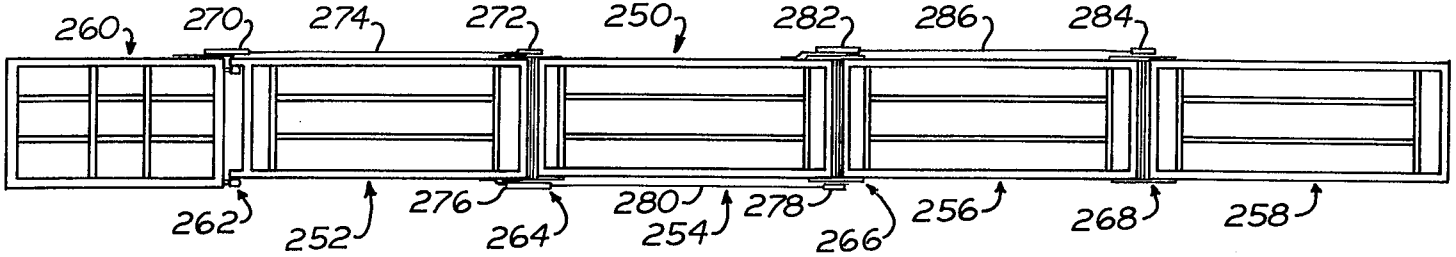
Figure 7:
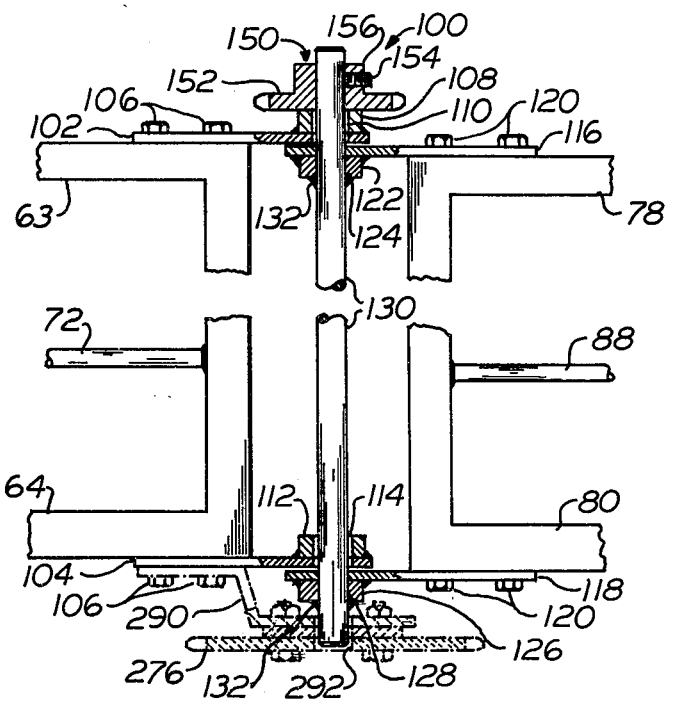
FIG. 7 is an enlarged, fragmentary, side elevational view of the rotatable juncture shown in FIG. 6.

The wing-forming members comprising the assembly 10 are joined in serial, pivotal relationship by intermediate rotatable junctures 100, best viewed in FIGS. 6 and 7. For the embodiment illustrated in FIGS. 1–3, utilizing two wing-forming members on each assembly 10 for purposes of a race horse starting gate, the rotatable juncture 100 joins the interior wing-forming member 60 and terminal wing-forming member 62. When three or more wing-forming members comprise the assembly, such as illustrated in FIG. 10, the rotatable juncture 100 joining the interior wing-forming members will include the structure shown in phantom lines in FIG. 7, described more fully hereinbelow.

The rotatable juncture 100 joining interior wing-forming member 60 with terminal wing-forming member 62 is designed to couple these members such that the deployment of the former from a collapsed configuration results in deployment of the latter, as best viewed in FIGS. 1 and 3. That is, juncture 100 is a coupled rotatable juncture.

The distal end of interior wing-forming member 60 is provided with upper and lower plates 102 and 104, respectively, affixed by means of, e.g., bolts 106. Plate 102 includes a generally cylindrical collar 108 having a bore 110. Lower plate 104 similarly includes a cylindrical collar 112 having a bore 114.

The terminal wing-forming member 62 is formed with a pair of upper and lower plates 116 and 118, respectively, affixed by means of, e.g., bolts 120. Upper plate 116 includes a cylindrical collar 122 having a bore 124; while lower plate 118 has a cylindrical collar 126 having a bore 128.

The bores 110, 114, 124, and 128 are adapted to receive a cylindrical shaft member 130 which defines the axis of rotation between the interior and exterior wing-forming members 60 and 62. The bores 110 and 114, which are identified with the interior wing-forming member 60 via plates 102 and 104, are somewhat oversized with respect to the shaft dimension in order that the same may rotate therein. A bushing, or other bearing structure, may optionally be incorporated to afford smooth rotation, which may become a more important consideration when the assembly 10 is comprised of more than two wing-forming members. The bores 124 and 128, identified with the terminal wing-forming member 62 via plates 116 and 118, are dimensioned to mate fairly closely with shaft 130. Once assembled in the configuration shown in FIG. 7, the cylindrical collars 122 and 126 are welded to shaft 130 by weld beads 132, although any other means of fixation may be employed. Accordingly, the shaft 130 is free to rotate with respect to interior wing-forming member 60 but is keyed with respect to terminal wing-forming member 62 in such a fashion that rotation of shaft 130 will cause arcuate movement thereof.

Primary fixed pivot means are associated with the rotatable juncture at the proximal end of each interior wing-forming member comprising the assembly. In the embodiment of FIGS. 1–3, one such primary pivot means 140, best viewed in FIG. 4, is provided. The primary fixed pivot means 140 is comprised of a sprocket 142 affixed to the upper member 32 of the support frame 30 by means of a plate 144. Plate 144 is shown to be secured by bolts 146, although it might be welded. The central axis of sprocket 142 is aligned coincident with the axis of rotation of rotatable juncture 90.

A secondary pivot means 150 is associated with each coupled rotatable juncture 100. For embodiment of FIGS. 1–3, one such secondary pivot is provided between the interior and terminal wing-forming members 60 and 62, best viewed in FIGS. 6 and 7. The secondary pivot means 150 is comprised of a sprocket 152 keyed to, or otherwise fixed for rotation with, shaft 130. As shown in FIG. 7, the sprocket 152 is secured to shaft 130 by threaded bolt 154 inserted through integral collar 156.

Linkage means are provided between successive primary fixed pivot means 140 and next successive pivot means 150 to define communicating pairs of pivots corresponding to each of the interior wing-forming members. In the embodiment of FIGS. 1–3, one such linkage member, designated generally as 160 in FIG. 2, provides operative communication between sprocket 142 and sprocket 152. Linkage member 160 is shown to be comprised of a chain element 162 for engaging the teeth of sprocket 142 and a separate chain element 164 for engaging the teeth of sprocket 152. A pair of rods 166 join the chain elements 162 and 164 into an endless loop configuration. In order to appropriately tension the linkage member 160, it is preferred that the rods 166 join the chain elements through turnbuckles 168.

Motors are preferably housed within the bed area 20 of truck 14 in order to provide motive power to the wing assemblies 10. Preferably, the motors utilized are electric motors, most preferably automotive starter motors. As shown in FIG. 3, a first motor 170 and a second motor 172 are powered by batteries 174 for deploying and collapsing, respectively, the assemblies 10. The motors drive a first shaft 176 which, via a chain 178, powers a transmission sprocket 180. Motion of sprocket 180 is translated through a shaft 182 and cooperating sprocket 184 to a main drive sprocket 186 via a chain member. Main drive sprocket 186 transmits the rotational power through a stub shaft 188 to an eccentric assembly 190. Other power transmission designs may be utilized, depending on the application for which the wing assemblies are employed, without departing from the scope of the present invention.

Figure 5:
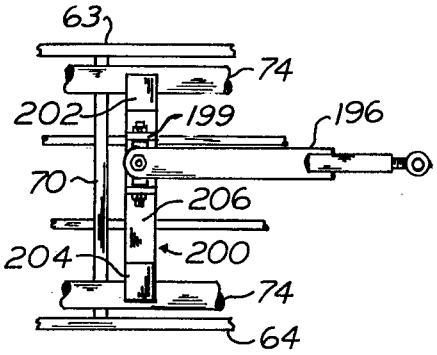
FIG. 5 is a fragmentary rear elevational view showing a connection joint for deployment of a wing assembly.

The eccentric assembly 190, best viewed in FIG. 2, is comprised of a circular plate 192 fixed for rotation with stub shaft 188. A drive arm 194 is bolted or otherwise secured to plate 192 for coincident rotation therewith. A pair of radial drive arms 196 join the drive arm 194 at ball joint connections 198, which provide a greater degree of mobility during movement of the wing assemblies. The radial drive arms 196 are attached to the opposing interior wing-forming members 60 at a rotatable joint 199 formed on a generally U-shaped bracket member 200, best viewed in FIGS. 5 and 8. The U-shaped bracket 200 is comprised of upper and lower arms 202 and 204, respectively, joined by an intermediate arm 206 to which the joint 199 is attached. The other end of each of the arms 202 and 204 is secured to tubular stiffening members 74, for example by welding.

Actuation of the assemblies 10 from a closed configuration as shown in FIG. 3 (with an intermediate configuration illustrated in phantom lines therein) to an open or deployed configuration as shown in FIG. 2 is achieved quite simply. Upon energizing the motor 170, its rotational motion is transmitted through drive transmission means to the drive arm 194 on circular plate 192, which is coupled through the ball joint connection and radial arm to the interior wing-forming member 60. As the interior wing-forming member 60 begins to rotate about juncture 90 in response to the outward pushing motion of arm 196, there will be a relative angular displacement of the axis defined as the center line through pin members 92; i.e., relative to the fixed primary pivot sprocket 142. This relative displacement is translated through linkage means 160 to the secondary pivot sprocket 152, causing this latter sprocket memeber to rotate about the cooperating chain element 164. It is to be noted that there is no longitudinal translation of linkage means 160; rather, the same serves to transmit rotation of juncture 90 into rotation of juncture 100. That is, the teeth on sprocket 152 "walk around" the relatively stationary chain element 164. Because the upper and lower plates 116 and 118 are fixed in rotational communication with shaft 130 bearing the sprocket 152, the rotation of wing-forming member 60 about juncture 90 results in direct rotation of terminal wing-forming member 62 about juncture 100.

Collapsing the deployed assemblies 10 to a closed configuration is achieved in identical manner, by actuation of reversing motor 172. This causes reverse rotation of plate 192 toward a position such as that shown in phantom lines in FIG. 2. In order to provide an optimum response between the successive wing-forming members comprising the assembly, it has been determined that the sprocket 152 should preferably have formed thereon a number of teeth equal to one less than twice the number of teeth formed on the primary sprocket 142.

Figure 9:
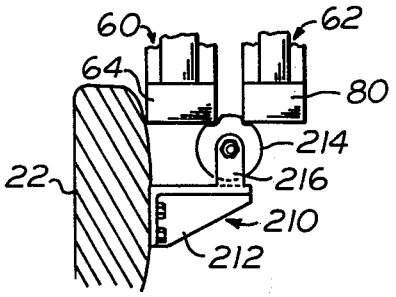
FIG. 9 is a fragmentary rear elevational view along one side of a vehicle, showing a restraining device for supporting a pair of wing-forming members in a collapsed configuration; and, FIG. 10 is a rear elevational view of an alternate embodiment of a wing assembly comprised of four wing-forming members.

When the assemblies 10 are associated with a vehicle for use a race horse starting gate it is desirable to provide a supporting mount for stabilizing the wing-forming members in the closed configuration during movement of the vehicle. FIG. 9 shows a preferred supporting mount attached to the side walls 22 of the truck 14. The mount, designated generally as 210, is comprised of a bracket 212 bolted or otherwise affixed to the wall 22 of the truck. A cylindrical resilient roll 214 is mounted on bracket 212 by a pair of upright members 216. As the assembly 10 is closed, the lower member 64 of the interior gate 60 will roll over the top surface of roller 214 and abut the side wall 22 with the lower edge beneath the top surface of the roller. As the terminal gate 62 moves to a closed position, the lower edge of member 80 will similarly abut the roller 214. Thus, as viewed in FIG. 9, the roller 214 locks or restrains the interior wing-forming member 60 while separating the two members comprising the assembly 10 for positive support during movement of vehicle 14.

In the embodiment of FIGS. 1 and 3, a starter's compartment 24 is shown to be elevated substantially above the level of the track (e.g., eight feet) such that the starter has a clear and unobstructed view of each of the horses positioned behind the gate. Controls for actuation of the gate assemblies 10 are provided within the starter's compartment, as are override controls for acceleration of the vehicle 14. Accordingly, a driver is positioned in the cab 16 merely for purposes of steering.

As best viewed in FIG. 3, the driver's access to the cab is not at all impeded by the assemblies 10, since the same does not extend up to the doors 18. This is a desirable feature provided by the present invention.

The structure of the present invention is highly adaptable for utility well beyond race horse starting gates. For example, the structure may be utilized as a collapsable gantry. Another use envisioned within the scope of the present invention is in the irrigation or tilling of agricultural fields, where a number of individual wing-forming assemblies may be joined for carrying flexible irrigation hose to conduct water from a suitable supply. FIG. 10 illustrates an embodiment which can be utilized for these and myriad other purposes.

The assembly of FIG. 10, noted generally as 250, is comprised of four wing-forming members 252, 254, 256, and 258, supported by a generally rectangular frame 260. The members 252, 254, and 256 are interior wing-forming members, whereas the member 258 is the terminal wing-forming member. The assembly 250 is pivoted about rotatable juncture 262 which corresponds with rotatable juncture 90 discussed above. The rotatable junctures 264 and 266 in this embodiment differ in structure from the intermediate juncture 100 insofar as the same now incorporates that portion of FIG. 7 shown in phantom lines, described below. Juncture 268 is identical with juncture 100 described above.

In general terms, the proximal ends of each of the interior wing-forming members are provided wtih a primary fixed member corresponding to that denoted 140 in FIG. 4; while the distal ends are provided with secondary pivot means such as that denoted 150 in FIG. 6. Successive primary and secondary pivot means are joined by linkage members corresponding to 160 in FIG. 2.

Consequently, a primary fixed pivot sprocket 270 is positioned at juncture 262 for cooperation with a secondary pivot sprocket 272 at juncture 264 via a linkage member 274. Similarly, a primary fixed pivot sprocket 276 is associated with juncture 264 for cooperation with a secondary pivot sprocket 278 via a linkage member 280. Likewise, a primary pivot sprocket 282 at juncture 266 cooperates with a secondary pivot sprocket 284 at juncture 268 via linkage member 286.

The intermediate rotatable junctures 264 and 266 each incorporate a primary and a secondary pivot sprocket. One suitable arrangement is illustrated in FIG. 7, where the primary pivot sprocket is located at the lower portion of the juncture as shown in phantom lines. Assuming the structure of FIG. 7 corresponds to juncture 264, the primary pivot sprocket is bolted to a secondary angled plate 290 which, itself, is affixed to the frame of the gate-forming member. The sprocket 276 is formed with an oversized central bore 292 in order that the shaft comprising the juncture may rotate without obstruction. At the juncture 266, the relationship of the primary pivot sprocket and secondary pivot sprocket will be reversed, the former on top and the latter on the bottom.

Other structural arrangements are well within the scope of the present invention. For example, both the primary and secondary pivot sprockets could be affixed to the same side (top or bottom) of the gate-forming members. The only essential requirement is that the primary pivot sprocket be fixed with respect to an interior wing-forming member while the secondary pivot sprocket is fixed in rotational communication with the next successive wing-forming member, whether interior or terminal.

While the invention has now been described with reference to certain preferred embodiments, the skilled artisan will recognize that various substitutions, modifications, changes, and omissions may be made without departing from the spirit thereof. Accordingly, it is intended that the scope of the present invention be limited solely by that of the following claims.

What I claim is:

1. A foldable wing assembly, comprising:

a. a mount for rotatably supporting a plurality of wing-forming members;

b. a plurality of wing-forming members including:

i. at least one interior wing-forming member, and, ii. a terminal wing-forming member;

c. rotatable juncture means at the proximal end of each of said wing-forming members joining said members in pivotal serial relationship;

d. primary, fixed pivot means disposed at each of said juncture means for each of said interior wing-forming members;

e. secondary pivot means journalled at the distal end of each of said interior wing-forming members;

f. coupling means, at the distal end of each of said interior wing-forming members and traversing the respective rotatable junctures, for securing said secondary pivot means on one wing-forming member to the proximal end of a next successive wing-forming member, whereby said secondary pivot means are fixed in rotational communication with said proximal ends; and, g. linkage means providing operative engagement between adjacent primary and secondary pivot means.

2. The assembly of claim 1, further comprising motive means engaging the first interior wing-forming member for displacement thereof in an arcuate path about the rotatable juncture between said first member and said mount.

3. The assembly of claim 1, wherein said pivot means comprise sprockets having peripheral teeth formed thereon.

4. The assembly of claim 3, wherein said linkage means comprises an endless chain member for engaging said teeth.

5. The assembly of claim 4, wherein said chain member is an adjustable chain member including a pair of adjustable rods joined at either end by chain segments.

6. The assembly of claim 3, wherein the primary pivot sprocket has one less than twice the number of teeth comprising the secondary pivot sprocket.

7. The assembly of claim 6, comprising two wing-forming members.

8. The assembly of claim 3, wherein said terminal wing-forming member is pivotally connected to the last interior wing-forming member by a coupled terminal rotatable juncture comprising:

a. a shaft journalled for rotation at the distal end of said last member;

b. a secondary sprocket fixed for rotation with said shaft; and, c. coupling means securing the proximal end of said terminal member to said shaft for causing coincident rotation thereof.

9. The assembly of claim 8, wherein successive interior wing-forming members are pivotally connected by coupled interior rotatable junctures, each comprising:

a. a shaft journalled for rotation at the distal end of a preceding wing-forming member;

b. a primary sprocket secured at the distal end of said preceding member;

c. a secondary sprocket fixed for rotation with said shaft; and, d. coupling means securing the proximal end of a successive wing-forming member to said shaft for causing coincident rotation thereof.

10. The assembly of claim 9, comprising at least three wing-forming members, wherein said linkage means are adjustable endless chain members disposed in units between adjacent primary and secondary sprockets, there being one less number of units than wing-forming members.

11. The assembly of claim 9, wherein:

a. the distal end of a wing-forming member preceding a rotatable juncture includes upper and lower bores for rotatably receiving said shaft; and b. the proximal end of the next successive wing-forming member includes upper and lower bores for securely receiving said shaft in fixed rotational communication therewith.

12. The assembly of claim 8, having two wing-forming members, wherein:

a. a primary sprocket is disposed at the rotatable juncture between said mount and the interior wing-forming member; and, b. said linkage means comprises a pair of chain segments joined into an endless loop configuration by a pair of adjustable rods, the first chain segment being in cooperative engagement with said primary sprocket and the second chain segment being in cooperative engagement with said secondary sprocket.

13. A starting gate for harness race horses, comprising:

a. a motor vehicle having an operator compartment and a rear compartment;

b. a pair of foldable gate assemblies attached to said rear compartment, each of said assemblies including a plurality of gate-forming members joined serially at rotatable junctures and moveable from a folded configuration, wherein said gate-forming members lie in substantially face-to-face orientation adjacent one side of said vehicle and disposed rearwardly of said operator compartment, to a deployed configuration, wherein said gate-forming members lie on a substantially common plane generally perpendicular to said vehicle;

c. power means disposed in said rear compartment and attached to the innermost gate-forming member of each of said assemblies for displacing said innermost members along an arc from said folded to said deployed configuration;

d. power transmission means for translating the arcuate displacement of said innermost gate-forming member sequentially to each successive gate-forming member comprising each assembly for causing successive displacement thereof, said power transmission means including coupling means bridging the rotatable junctures between successive gate-forming members;

e. a starter compartment in said rear compartment and disposed vertically above said vehicle; and, f. vehicle acceleration and gate assembly displacement control means located in said starter compartment.

14. The starting gate of claim 13, wherein said power means comprises an eccentric including a pair of arm members joining a rotatable plate member with each of said foldable gate assemblies.

15. The starting gate of claim 13, wherein each of said gate assemblies comprises:

a. a mount for rotatably supporting a plurality of gate-forming members on said rear compartment;

b. a plurality of gate-forming members including:

i. interior gate-forming members having a first gate-forming member; and, ii. a terminal gate-forming member;

c. rotatable juncture means at the proximal end of each of said gate-forming members joining said members in pivotal, serial relationship;

d. primary, fixed pivot means disposed immediately inwardly of each of said juncture means for each of said interior gate-forming members;

e. secondary pivot means journalled at the distal end of each of said interior gate-forming members;

f. coupling means, at the distal end of each of said interior gate-forming members and traversing the respective rotatable junctures, for securing said secondary pivot means on one gate-forming member to the proximal end of a next successive gate-forming member, whereby said secondary pivot means are fixed in rotational communication with said proximal ends; and, g. linkage means providing operative engagement between adjacent primary and secondary pivot means.

* * * * *